US008253049B2

(12) United States Patent
Grisby

(10) Patent No.: US 8,253,049 B2
(45) Date of Patent: Aug. 28, 2012

(54) DECORATIVE LIGHT SWITCH COVER

(76) Inventor: Anthony Grisby, Lexington, KY (US)

( * ) Notice: Subject to any disclaimer, the term of this patent is extended or adjusted under 35 U.S.C. 154(b) by 287 days.

(21) Appl. No.: 12/725,880

(22) Filed: Mar. 17, 2010

(65) Prior Publication Data

US 2010/0170773 A1 Jul. 8, 2010

Related U.S. Application Data

(63) Continuation-in-part of application No. 29/310,970, filed on Sep. 22, 2008, now Pat. No. Des. 615,048.

(60) Provisional application No. 61/210,602, filed on Mar. 20, 2009.

(51) Int. Cl.
*H01H 9/18* (2006.01)

(52) U.S. Cl. ..... 200/330; 200/331

(58) Field of Classification Search ..... 200/330, 200/331; 74/544; 174/66, 67; 403/65, 73, 403/119; 446/323; D8/300, 321, 322; D13/158, D13/168, 169, 173, 174; D26/59, 59.72, D26/72

See application file for complete search history.

(56) References Cited

U.S. PATENT DOCUMENTS

| | | | | | |
|---|---|---|---|---|---|
| 2,382,738 | A | | 3/1944 | Moyses | |
| 2,726,303 | A | * | 12/1955 | Berndsen | 200/331 |
| 3,142,744 | A | | 7/1964 | Keck | |
| 3,175,420 | A | | 3/1965 | Craig | |
| 3,581,037 | A | | 5/1971 | Schiffelbein | |
| 3,722,319 | A | | 3/1973 | Reznik et al. | |
| 4,234,774 | A | * | 11/1980 | Paparella | 200/330 |
| 4,256,943 | A | | 3/1981 | Whitlock | |
| 4,419,556 | A | * | 12/1983 | Hare | 200/331 |
| 4,731,511 | A | * | 3/1988 | Steinhilber et al. | 200/330 |
| 5,055,645 | A | * | 10/1991 | Hull et al. | 200/331 |
| D326,445 | S | | 5/1992 | Enyeart | |
| 5,124,513 | A | * | 6/1992 | Blair | 200/331 |
| D351,324 | S | | 10/1994 | Neppl | |
| D355,643 | S | | 2/1995 | Warnock et al. | |
| D381,636 | S | | 7/1997 | Bush | |
| 5,806,665 | A | | 9/1998 | Houssian | |
| D429,222 | S | | 8/2000 | Phillips et al. | |
| 6,444,909 | B1 | | 9/2002 | Prenderville | |
| 6,822,177 | B1 | | 11/2004 | LaPlante | |
| 7,038,153 | B2 | * | 5/2006 | Zamecnik | 200/330 |
| 2005/0263382 | A1 | * | 12/2005 | Desmond | 200/331 |

* cited by examiner

*Primary Examiner* — Michael Friedhofer
(74) *Attorney, Agent, or Firm* — Michael Coblenz

(57) ABSTRACT

A slip on cover for the end portion of the toggle of a light switch is disclosed. The cover can slip over the toggle and adhere by suction or friction. The cover can provide a variety of decorative features, including color and glow in the dark feature to allow a person to easily find the light switch in the dark. It can provide protection for the light switch toggle to limit damage. The light switch cover can also incorporate various decorative features at the end of the light switch, including balls and hats and a wide variety of other shapes.

18 Claims, 3 Drawing Sheets

DECORATIVE LIGHT SWITCH COVER

CROSS REFERENCE TO RELATED APPLICATIONS

This application claims priority to U.S. Provisional Patent Application No. 61/210,602 filed on Mar. 20, 2009, and is a continuation in part of U.S. Design Application No. 29/310,970, filed Sep. 22, 2008.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

FIELD OF THE INVENTION

The invention relates to a slip on cover for the toggle portion of an electric light switch.

BACKGROUND OF THE INVENTION

Light switches are common and well know. They are in most rooms of most buildings around the world. There are two components to the standard electric wall switch or light switch. The switch itself and the switch plate cover. The switch itself is comprised of a protruding toggle that is manipulated to activate the electric switch portion contained in the body of the switch. The switch plate cover protects the electric components of the switch. Switch plate covers come in a variety of different sizes, styles, and configurations to match the decor of a room. It is also common for switch plate covers to be changed or altered by painting or covering with wall paper, to match the decor in a room. There is no similar way to change the color or style of the toggle portion of the light switch itself other than painting the toggle.

Lights switches and electric wall switches have a small lever, commonly referred to as the toggle, that is moved to turn on or off the power to the associated electric component. The most common components are the lights in a room, but some switches control other electric components, such as electric outlets. Virtually all homes, offices, commercial, industrial, and agricultural buildings have electric wall switches. Old wall switches had two buttons, but switches produced and installed since the 1950's have been the familiar light switch with a switch plate to cover the electronic component, and a switch that extends from the plate.

There are a number of existing patents that disclose the addition of a lever to the end of the toggle to allow the electric switch to be turned on and off in a position away from the toggle. The most common situation involves an extension that allows a child, or person in a wheel chair, to turn on and off the lights from a position below the standard light switch. Examples of such a toggle extension include U.S. Pat. No. 3,722,319 to Reznik et al, and U.S. Pat. No. 4,256,943 to Whitlock.

SUMMARY OF THE INVENTION

The invention is a cover for the toggle portion of a standard light switch or electric wall switch. The cover is designed to snugly fit over the toggle. The light switch cover will be made from soft plastic, rubber, or any other soft and flexible material. The interior dimensions of the light switch cover will be roughly the same size as the outside dimensions of the toggle switch so that the light switch cover can slip on and stay attached to the toggle by suction or friction. This will allow the light switch cover to remain in place, but also removable for changing or replacement. In the alternative, the light switch cover can be more permanently attached with a variety of adhesives.

The light switch cover can come in any colors to match the color or decor of the room. In various embodiments the light switch cover can be in a matching color to fit with or complement the decor of a room, on in a contrasting color to help make the light switch visible in a room. For example a light switch in an industrial setting might have a bright red or orange light switch cover to make the location of the light switch more visible. Light switch covers can also be made from a phosphorescent or glow in the dark material to make the light switch visible in a dark room.

Light switch covers can also have any number of decorative features to make them coordinate with the decor of a room. For example a light switch cover could have a small baseball or ball-cap at the end for use in a boy's room. Other configurations, for example in the shape of a cute animal face, might be more appropriate for a girl's room. It is conceivable that the light switch cover could also be made in an unusual or grotesque shape for amusement or entertainment. Light switch covers could also be fanciful, and made in the shape of body parts, such as a tongue, a nose or a finger.

The disclosed light switch cover serves numerous purposes, including decorative, safety and utilitarian purposes. Decorative purposes consist of color and design coordination. Safety purposes include such features as glow in the dark, or visibly contrasting light switch cover. Utilitarian purposes include protecting the light switch, thus allowing a building owner to change the light switch cover rather than the entire light switch after unusual damage or after normal wear and tear. An additional utilitarian feature would be that a fanciful light switch cover might induce young children to properly turn on and off lights in a room.

DETAILED DESCRIPTION OF THE INVENTION

Detailed embodiments of the present invention are disclosed herein. It is to be understood that the disclosed embodiments are merely exemplary of the invention and that the invention may be embodied in various and alternative forms. Therefore, specified structural and functional details disclosed herein are not to be interpreted as limitations, but merely as a basis for the claims and as a representative basis for teaching one skilled in the art to variously employ the present invention.

Figure 1:
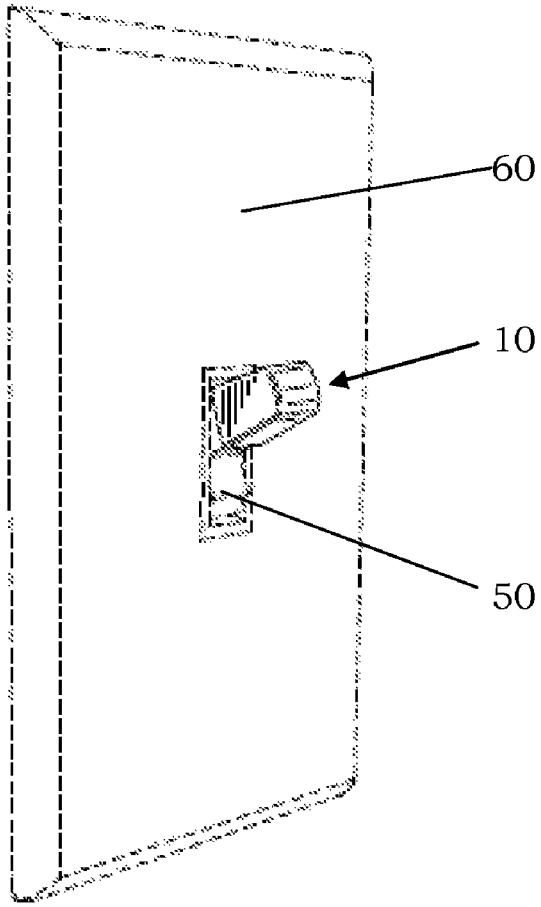
FIG. 1 is a perspective view of the light switch cover attached to a conventional light switch toggle.

FIG. 1 shows the preferred embodiment of the light switch cover 10 in position on the toggle 50 a standard light switch 50. Also shown is a standard switch plate cover 60. Conventional light switches are well known in the art, and are found in almost every home and building. The light switch turns on and off lights within a room. Some light switch are also connected to standard electric outlet boxes and so can be used to turn on and off other electric equipment within a room. Switch plate covers 60 come in a variety of sizes, shapes and colors in order to provide the purchaser with a range of decorative features. Toggles 50, however, generally come in only a few colors. The most common are white, ivory (or off white), and grey for industrial use. It is very common for homeowners to upgrade their switch plate covers 60 to match the decor of a room. The switch plate cover 60 is often painted the color of the surrounding wall, or often covered in the same wall paper as on the wall. It is also common for parents to decorate a child's room in sports themes, or cartoon characters, and switch plate covers 60 with sports equipment or fanciful characters are quite common. In all of these cases the toggle 50 remains the original color, typically white or ivory.

Figure 2:
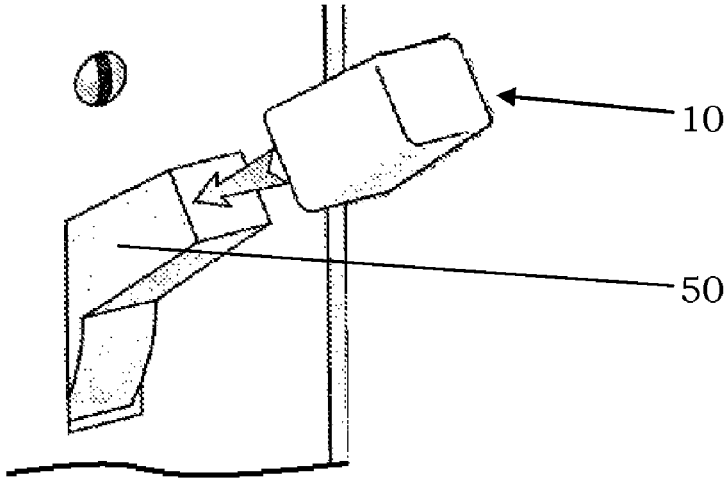
FIG. 2 is a perspective exploded view of the light switch cover off of a conventional light switch toggle.
Figure 3:
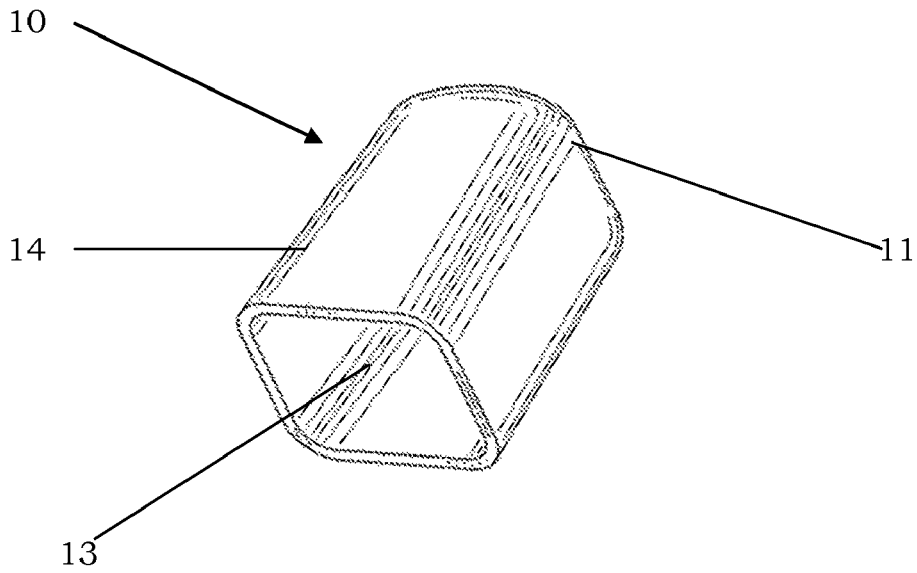
FIG. 3 is a detailed perspective view of the light switch cover.

The present invention is a light switch cover 10 that slips onto the toggle 50 of a standard light switch. The light switch cover 10 is sized to fit snuggly over the toggle 50. The light switch cover 10 adheres to the toggle 50 by friction or suction. Such snug fitting slip on components are well known in the art. While the friction based snug fit will be sufficient to keep the light switch cover 10 in place, it is also possible that some users may wish to more permanently secure the light switch cover 10 with a drop of glue or other adhesive. FIG. 2 is an exploded view showing the light switch cover 10 in position to be slipped onto the toggle 50. FIG. 3 is a detail of the light switch cover 10. Typical household toggles 50 are approximately one quarter inch by one quarter inch at the tip, and about one half inch long. Heavy duty light switches for use in industrial facilities are often slightly larger. Some toggles 50 have an essentially square cross section, while others have a slightly rectangular cross section. The light switch cover 10 is sized with an internal dimension the same as the standard toggle 50. Standard toggles 50 also have a slight taper, and the light switch cover 10 is designed with a corresponding taper.

In the preferred embodiment the light switch cover 10 is made of soft plastic. This material is suitable because it is both flexible and durable. In some cases it can also have a slight stickiness, which will allow it to stay in place on the toggle 50. The use of soft plastics with slight tackiness is well known in the art, and a common way to securely, yet temporarily attach a covering to a hard body. It is possible to construct the light switch cover 10 of any suitably soft, flexible and durable material, such as Mylar, moldable soft plastics, moldable hard rubbers and a wide variety of synthetic materials. The light switch cover 10 is molded from a single piece of material. It is molded with a taper to conform to a standard light switch toggle 50. There are two common sizes of toggle 50, one for standard household use, and a slightly larger size for industrial and commercial use. The light switch cover 10 can easily be made to fit either standard size, and could easily be made to fit any specialized size. It is, therefore, within the conception of the invention for the light switch cover 10 to be sized to fit any light switch toggle 50.

As seen in detail in FIG. 3, the light switch cover 10 has an outside wall 12 with a top 11 and four sides 12 which define an internal space 13 which is sized to conform to the dimensions of a toggle 50. The taper in the walls is designed to allow the light switch cover 10 to slip onto the toggle 50. The slight flex of the material allows the cover 10 to slide on and snuggly fit onto the light switch by means of friction.

The light switch cover 10 can be produced in any color of the visible light spectrum. This will allow a user to purchase a light switch cover 10 to match the color of the switch plate 60 and the decor of the room. It is also possible that a user might prefer for the light switch cover 10 to be a contrasting color to stand out in the room. In some settings, such as in industrial or manufacturing facilities, the light switch cover 10 would be in a highly visible color such as bright red or orange, so that workers in the facility can easily spot the toggle 50 to turn on or off the lights. The light switch cover 10 can also be produced with phosphorescence of glow in the dark properties. The use of glow in the dark plastics is well known. The will create a light switch cover 10 that is visible in a dark room. These contrasting colors or glow in the dark light switch covers 10 provide an important safety feature.

Figure 4:
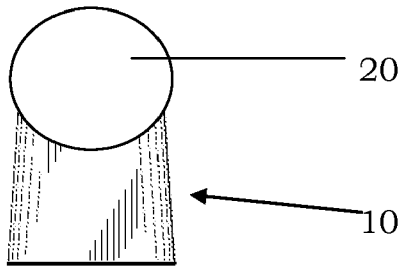
FIG. 4 is a perspective view of the light switch cover with a decorative ball.
Figure 5:
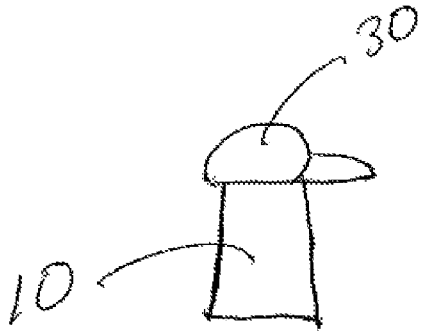
FIG. 5 is a perspective view of the light switch cover with the decorative feature of a hat.
Figure 7:
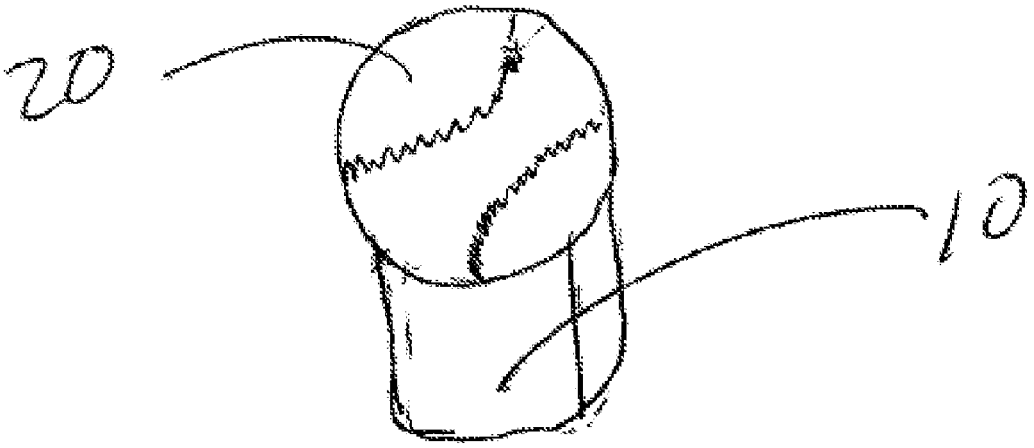
FIG. 7 is a perspective view of the light switch cover with a baseball.

In an alternate embodiment of the invention, as shown in FIGS. 4 & 5, the light switch cover 10 would incorporate other decorative features. Through the process of injection molding it is quite easy to create any shape object from rubber, soft plastics, and other polymer materials. FIG. 4 includes a ball 20 positioned at the top 11 of the light switch cover 10. In this figure the ball is a simple sphere, but it is understood that the ball could be any common type of ball, including, but not limited to a baseball, basketball, bowling ball, tennis ball, golf ball, soccer ball, or any other type of sports or play ball. FIG. 7 depicts the ball as a baseball. While the ball 20 in FIG. 4 is shown as a sphere, it is also possible to include a non-spherical ball such as a rugby ball or football. It is also possible, and within the conception of the invention to include other sports equipment, such as a hockey puck or baseball glove. It is also possible, and within the conception of the invention to include a wide variety of other sports equipment, such as the basic outline of a baseball bat, tennis racquet, lacrosse stick, golf club, hockey stick. It is also possible, and within the conception of the invention to mold the end of the light switch cover 10 in the form of a sports shoe. It is also possible, and within the conception of the invention for the light switch cover 10 to be molded into the colors and configuration of sports team jerseys. Through the process of injection molding it is easy to incorporate color features into the molded product.

FIG. 5 shows the light switch cover 10 with an incorporated hat 30. In FIG. 5 the hat 30 is a baseball cap, but it is within the conception of the invention to mold the hat into any conceivable hat or sports helmet, such as a football helmet. While many of the previous examples set forth above have involved toys associated with boys, it is within the conception of the invention to mold the hat 30, and the light switch cover 10, into toys and figures associated with girls as well. This includes, but it not limited to doll-like figures, fanciful princess hats and the like.

It is also possible, and within the conception of the invention to mold the light switch cover 10 to have a face of other similar features. It is possible and within the conception of the invention to mold the light switch cover 10 into the configuration of common cartoon characters, such as Mickey Mouse, Batman, Barbie, or any other well known character. It is also possible, and within the conception of the invention, to mold the light switch cover 10 into the shape of animals and animal heads and faces, and to incorporate color to make the light switch cover 10 appear like a small animal head. This could include any known animal, but would certainly include such popular animals as dogs, cats, squirrels, and birds. It is also possible, and within the conception of the invention, to mold the light switch cover 10 into fanciful figures, such as fingers, toes, and noses, and also grotesque figures such as severed fingers, toes and noses.

Figure 6:
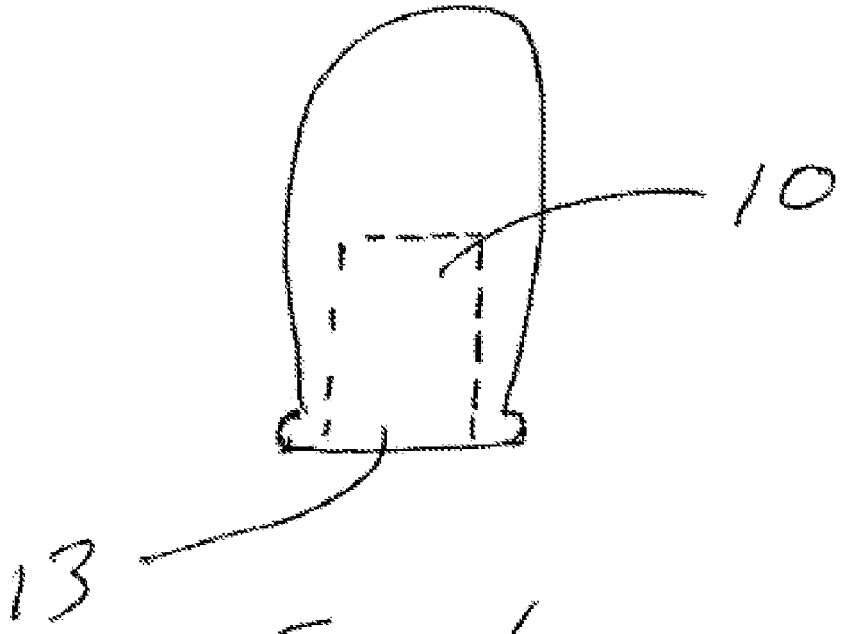
FIG. 6 is a front elevation view of the light switch cover configured as a ball bat.

There are at least two possibilities if the light switch cover 10 incorporates a ball 20, a hat 30 or other fanciful shape. It can be molded so that the light switch cover 10 is the shape, with the internal space 13 inside the fanciful shape. FIG. 6 depicts the light switch cover 10 in the shape of a short, stubby baseball bat. This figure also discloses the internal space 13 formed by the walls 12. In an alternative embodiment, the shape can be molded at the end of the light switch cover 10. For example the walls 12 that attaches to the toggle 50 could be in the shape of a bat and there could be a small baseball attached at the end. Virtually any small shape could be attached at the end of the light switch cover 10. The only limitation would be that the shape at the end could not be so big as to interfere with the movement of the toggle 50. It is understood that the addition of a ball 20, hat 30 or other small fanciful shape at the end of the light switch cover 10 might make it easier for small children be able to turn on and off lights, and therefore might make it more likely that they would properly turn on and off the lights.

The present invention is well adapted to carry out the objectives and attain both the ends and the advantages mentioned, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only by the spirit and scope of the claims, giving full cognizance to equivalents in all respects.

I claim:

1. A decorative light switch cover for the toggle of a conventional electric switch, said light switch cover comprising:

a tapered body made of a soft pliable material having a high coefficient of friction with an end and a tapered internal space having an internal surface;

said toggle having an external surface;

said internal space sized to conform to the shape of the toggle such that said taped body will snuggly fit over the toggle such that said internal surface of said body is fully in contact with said external surface of said toggle such that it creates a friction fit on the toggle, and a decorative feature attached to the body of the light switch cover.

2. The decorative light switch cover of claim 1, wherein said decorative feature consists of color.

3. The decorative light switch cover of claim 1, wherein said decorative feature consists of said body being made of glow-in-the-dark material.

4. The decorative light switch cover of claim 1, wherein said decorative feature consists of a ball shaped feature attached to the end of said body.

5. The decorative light switch cover of claim 1, wherein said decorative feature consists of hat shaped feature attached to the end of said body.

6. The decorative light switch cover of claim 1, wherein said decorative feature consists of said body being made in a fanciful shape.

7. The decorative light switch cover of claim 6, wherein said fanciful shape is sports equipment.

8. The decorative light switch cover of claim 6, wherein said fanciful shape is an animal.

9. The decorative light switch cover of claim 6, wherein said fanciful shape is a cartoon figure.

10. A slip on cover for the toggle of an electric switch comprising;

a tapered body made from a flexible material with a tapered internal opening having an internal surface;

said toggle having a tapered external surface;

said internal tapered opening sized just slightly smaller than the external surface of the toggle such that the flexible nature of the body allows it to be stretched over the toggle to created a suction fit on the toggle and is retained thereon;

said body having an external surface wherein said external surface is configured with decorative features.

11. The slip on cover of claim 10, wherein said decorative feature consists of coloring incorporated in said body.

12. The slip on cover of claim 10 wherein said decorative feature consists of said body in the shape of a ball.

13. The slip on cover of claim 10 wherein said decorative feature consists of said body in the shape of sports equipment such as a baseball bat, a sports shoe or a tennis racket.

14. A decorative toggle cover for the toggle of an electric switch comprising;

A tapered multisided body having four sides and an enclosed end wherein the sides define a tapered central opening having an internal surface;

said toggle having a four sided external surface;

said central opening sized and shaped to correspond to said toggle such that said internal surface is fully in contact with said external surface;

an adhesive placed on said external surface of said toggle such that it creates a bond between said external surface of said toggle and said internal surface of said tapered multisided body such that said body is attached to said toggle;

and wherein said multisided body is configured into fanciful shapes.

15. The decorative toggle cover of claim 14 wherein said fanciful shape is a ball.

16. The decorative toggle cover of claim 14 wherein said fanciful shape is a hat.

17. The decorative toggle cover of claim 14 wherein said fanciful shape is a baseball bat.

18. The decorative toggle cover of claim 14 wherein said fanciful shape is a sports jersey with coloring.

* * * * *